US011660247B2

(12) United States Patent
Park

(10) Patent No.: US 11,660,247 B2
(45) Date of Patent: May 30, 2023

(54) MULTIPURPOSE ARTICLE FOR BODILY ACUPRESSURE AND MASSAGE

(71) Applicant: Min Gyu Park, Busan (KR)

(72) Inventor: Min Gyu Park, Busan (KR)

( * ) Notice: Subject to any disclaimer, the term of this patent is extended or adjusted under 35 U.S.C. 154(b) by 0 days.

(21) Appl. No.: 17/868,174

(22) Filed: Jul. 19, 2022

(65) Prior Publication Data

US 2023/0121975 A1 Apr. 20, 2023

(51) Int. Cl.
*A61H 39/04* (2006.01)
*A61H 7/00* (2006.01)

(52) U.S. Cl.
CPC ..... *A61H 7/003* (2013.01); *A61H 39/04* (2013.01); *A61H 2201/0153* (2013.01); *A61H 2201/1692* (2013.01); *A61H 2201/1695* (2013.01)

(58) Field of Classification Search
CPC ..... A61H 7/00; A61H 7/003; A61H 39/04; A61H 2201/0153; A61H 2201/1692; A61H 2201/1695
See application file for complete search history.

(56) References Cited

U.S. PATENT DOCUMENTS 564,258 A * 7/1896 Name not available ..... A61N 1/00 439/19
D318,202 S * 7/1991 Weber ..... D6/601
5,231,977 A * 8/1993 Graston ..... A61H 7/003 601/34
5,366,437 A * 11/1994 Graston ..... A61H 7/003 601/134
5,441,478 A * 8/1995 Graston ..... A61H 7/003 601/135
D386,571 S * 11/1997 Wilhelm ..... D6/406.3
(Continued)

FOREIGN PATENT DOCUMENTS

CN 203226397 U * 10/2013
JP 3129905 U * 2/2007
(Continued)

OTHER PUBLICATIONS

"Instrument Assisted Soft Tissue Mobilization Tools", Wellmart.ca, captured by waybackmachine, published date according to wayback machine capture is Mar. 8, 2021.*
(Continued)

*Primary Examiner* — Tu A Vo
(74) *Attorney, Agent, or Firm* — IPLA P.A.

(57) ABSTRACT

A bodily acupressure and massage article includes: a main member defined by an elongate bottom, an arched top formed in accordance with a top arc radius, a substantially flat front, a substantially flat rear, and arched sides each formed in accordance with a side arc radius and extending from the arched top; a first protrusion downwardly, outwardly extending from a first end of the elongate bottom and semi-circularly formed in accordance with a first protrusion arc radius; and a second protrusion downwardly, outwardly extending from a second end of the elongate bottom and semi-circularly formed in accordance with a second protrusion arc radius, where the top arc radius is larger than the respective side arc radiuses, and the side arc radiuses are each larger than the respective first and second protrusion arc radiuses.

17 Claims, 4 Drawing Sheets

(56) References Cited

U.S. PATENT DOCUMENTS

| | | | | | |
|---|---|---|---|---|---|
| 6,077,239 | A * | 6/2000 | Lin | A61H 7/003 601/134 |
| D443,434 | S * | 6/2001 | Tinsley | D6/406.3 |
| D544,608 | S * | 6/2007 | Hsu | D24/214 |
| D586,469 | S * | 2/2009 | Henry | D24/200 |
| D613,979 | S * | 4/2010 | Moore | D6/707.22 |
| D632,400 | S * | 2/2011 | Bludorn | D24/189 |
| D677,394 | S * | 3/2013 | Grust | D24/215 |
| D678,539 | S * | 3/2013 | Narson | D24/200 |
| D683,862 | S * | 6/2013 | Hartman | D24/214 |
| D684,702 | S * | 6/2013 | Cho | D24/215 |
| D686,333 | S * | 7/2013 | Innes | D24/215 |
| 8,801,642 | B1 * | 8/2014 | Slominski | A61H 7/001 601/134 |
| RE45,657 | E * | 8/2015 | Cho | D24/215 |
| D752,238 | S * | 3/2016 | Stock | D24/214 |
| D753,317 | S * | 4/2016 | Eddy | D24/214 |
| D757,281 | S * | 5/2016 | Hsieh | D24/200 |
| D792,600 | S * | 7/2017 | van den Dries | D24/215 |
| D792,601 | S * | 7/2017 | van den Dries | D24/215 |
| D825,068 | S * | 8/2018 | van den Dries | D24/200 |
| D825,069 | S * | 8/2018 | Capobianco | D24/200 |
| D827,848 | S * | 9/2018 | Iwagami | D24/215 |
| D828,924 | S * | 9/2018 | Maroney | D24/200 |
| D865,988 | S * | 11/2019 | Pudhnum | D24/214 |
| D866,781 | S * | 11/2019 | Maroney | D24/200 |
| D868,279 | S * | 11/2019 | Chiu | D24/214 |
| D868,980 | S * | 12/2019 | Yang | D24/200 |
| D868,986 | S * | 12/2019 | Lefebvre | D24/214 |
| D882,808 | S * | 4/2020 | Miller | D24/215 |
| D885,596 | S * | 5/2020 | McKiernan, IV | D24/200 |
| D908,905 | S * | 1/2021 | Braden | D24/215 |
| D908,906 | S * | 1/2021 | Braden | D24/215 |
| D912,262 | S * | 3/2021 | Rubinshteyn | D24/214 |
| D931,491 | S * | 9/2021 | Marshall | D24/215 |
| D951,468 | S * | 5/2022 | Yu | D24/214 |
| D951,469 | S * | 5/2022 | Yu | D24/214 |
| 2006/0247563 | A1 * | 11/2006 | Martin | A61H 7/003 601/135 |
| 2007/0191745 | A1 * | 8/2007 | Tucker | A61H 7/003 601/135 |
| 2012/0158040 | A1 * | 6/2012 | Dehors | A61H 7/003 606/201 |
| 2013/0289457 | A1 * | 10/2013 | Rossbach | A61H 23/0263 601/160 |
| 2014/0213945 | A1 * | 7/2014 | Kojima | A61H 39/04 601/137 |
| 2016/0082307 | A1 * | 3/2016 | Widerman | A61H 39/04 482/139 |
| 2018/0079572 | A1 * | 3/2018 | van den Dries | A61H 37/00 |
| 2019/0008716 | A1 * | 1/2019 | Giddings | A61H 7/003 |
| 2019/0029916 | A1 * | 1/2019 | Ennis | A61H 7/003 |
| 2019/0307635 | A1 * | 10/2019 | Sultana | A61H 7/001 |
| 2020/0085670 | A1 * | 3/2020 | Hanson | A61H 7/003 |
| 2020/0138664 | A1 * | 5/2020 | Hanson | A61H 7/007 |
| 2021/0093503 | A1 * | 4/2021 | Restiano | A61H 7/003 |
| 2021/0298987 | A1 * | 9/2021 | Restiano | A45D 40/26 |
| 2022/0062089 | A1 * | 3/2022 | Martinez Millet | A61H 7/003 |

FOREIGN PATENT DOCUMENTS

| | | | | |
|---|---|---|---|---|
| KR | 2019970020864 | | 6/1997 | |
| KR | 200173976 | Y1 * | 12/1999 | |
| KR | 2001732240000 | | 12/1999 | |
| KR | 2002506270000 | | 10/2001 | |
| KR | 2003061330000 | | 2/2003 | |
| KR | 20090021245 | A * | 3/2009 | |
| KR | 2020110000295 | | 1/2011 | |
| WO | WO-2006017958 | A1 * | 2/2006 | A61H 7/003 |
| WO | WO-2020165921 | A1 * | 8/2020 | A61H 1/00 |

OTHER PUBLICATIONS

English translation for KR 200173976, machine translated by SEARCH clarivate analytics, translated on Apr. 6, 2022.*

English translation for JP 3129905, machine translated by SEARCH clarivate analytics, translated on Apr. 6, 2022.*

English translation for CN 203226397, machine translated by SEARCH clarivate analytics, translated on Apr. 6, 2022.*

English translation for WO 2006017958, machine translated by SEARCH clarivate analytics, translated on Apr. 6, 2022.*

English translation for KR 20090021245, machine translated by SEARCH clarivate analytics, translated on Apr. 6, 2022.*

* cited by examiner

MULTIPURPOSE ARTICLE FOR BODILY ACUPRESSURE AND MASSAGE

CROSS REFERENCE

This application claims foreign priority under Paris Convention to Korean Patent Application No. 10-2021-0139699 filed 19 Oct. 2021 with Korean Intellectual Office, all of which are incorporated by reference herewith.

BACKGROUND

This invention relates to an article for bodily acupressure and massage, and more particularly, to an improved multipurpose bodily acupressure and massage article, enabling a user to readily utilize the article for soothing and lessening a bodily fatigue, a muscle pain and other bodily discomforts.

When it comes to massaging devices, widely available on the market are massage chairs which are inevitably costly and limited to those ready to invest a relatively high fund. Even a simple massage chair model would easily cost a couple of grans.

Alternatives would be a variety of massage articles that have been introduced on the market, most of which seem to employ an article with a hand grip or a handle. An example is a massage stick with a handle to facility its usage in padding sore parts of a human body to combat sore muscles, break up muscular adhesions, and promote blood flow to aid in recovery.

As disclosed in Korean Patent and Utility Model Publication Nos. KR20-0145419, KR20-0250627, KR20-0306133, KR20-2011-0000295, KR10-1988-0002501 and KR20-0173224 (all being submitted as IDS herewith), the conventional massage devices or articles deal require a plurality of parts including electric or electronic units, thus resulting in cost increase and inconvenience in storage. Further, those conventional devices had limitation in performing massage and acupressure along bodily points recommended in oriental or traditional medicine-free treatments.

Another disadvantage of the conventional massage articles sees product reliability coming from electric and electronic units combined in a single device, resulting in frequent repair requirements in addition to the relatively high purchase cost.

SUMMARY OF THE INVENTION

Accordingly, the present invention has been contrived to overcome the conventional disadvantages.

An objective of the present invention is to provide a bodily acupressure and massage article enabling a user alone to perform acupressure and massage on and along the user's body without help of a third party, thus maximizing product usability.

Another objective is to allow a user alone to easily massage or acupressure on and along bodily meridian points designated in the traditional acupressure and acupuncture practices, thus improving product reliability.

Still another objective is to provide a massage and acupressure article made preferably of wood in a handy, light format at a lower cost without adding any electronic or motor-operated unit, thus maximizing product satisfaction.

In order to satisfy these and other objectives, a bodily acupressure and massage article according to the present invention comprises: a main member defined by an elongate bottom, an arched top formed in accordance with a top arc radius, a substantially flat front, a substantially flat rear, and arched sides each formed in accordance with a side arc radius and extending from the arched top; a first protrusion downwardly, outwardly extending from a first end of the elongate bottom and semi-circularly formed in accordance with a first protrusion arc radius; and a second protrusion downwardly, outwardly extending from a second end of the elongate bottom and semi-circularly formed in accordance with a second protrusion arc radius, where the top arc radius is larger than the respective side arc radiuses, and the side arc radiuses are each larger than the respective first and second protrusion arc radiuses.

The elongate bottom may be formed larger than a thickness of the main member in length or about three times larger than a thickness of the main member in length. A predetermined gap may be formed between the elongate bottom and an imaginary line linking each lower point of the outer peripheries, where the predetermined gap is between a half and two thirds of a thickness of the main member. The main member and the first and second protrusions may be substantially constant and even in thickness. A looped outer ridge of the article is formed by linking the elongate bottom, the arched top, the arched sides, and respective outer peripheries of the first and second protrusions, wherein a cross section taken against the looped outer ridge is substantially arched. A thickness of the main member is formed ranging between 12 mm and 14 mm, preferably at about 13 mm. Each thickness of the first and second protrusions the thickness is formed ranging between 12 mm and 14 mm or preferably at about 13 mm.

Each thickness of the main member and side protrusions may be substantially identical. Each distance between a tip point of the arched top and the first end of the elongate bottom is substantially identical. Each distance between a tip point of the arched top and the second end of the elongate bottom is substantially identical. A tip point of the arched top, and the first and second ends of the elongate bottom are equilaterally triangular when linearly connected. The elongate bottom is about three times larger than a thickness of the main member in length. The main member and the first and second protrusions may be formed of an identical material, an identical natural material, a natural wood, a hardened natural wood or composite wood.

The advantages of the present invention are: (1) the two pronged protrusions of the acupressure and massage article enabling a use to perform efficient acupressure and massage on and along bodily meridian pair points traditionally designated on a human body at a nominal cost of the article made of wood; (2) the grip friendly curvature and functional design allowing a user alone to perform a bodily tapping for an acupressure effect in a random grip and a bodily scrubbing for a massage effect by an easy holding of the massage article; (3) a handy and grip friendly design enabling a user alone to perform acupressure and massage on and along the user's body with a random grip of the article with ease; and (4) a low cost massage article allowing a user to improve blood circulation by using the article for a bodily massage, a facial massage, a temple massage, and other limitless applications to the user's body parts.

BRIEF DESCRIPTION OF DRAWINGS

The foregoing, along with other and further embodiments and aspects of the disclosed inventions, with now be described in greater detail in the below detailed description, to be read in view of the accompanying figures, wherein like reference numerals refer to like elements and the description for like elements shall be applicable for all described embodiments wherever relevant.

DETAILED DESCRIPTION OF THE INVENTION

Figure 1:
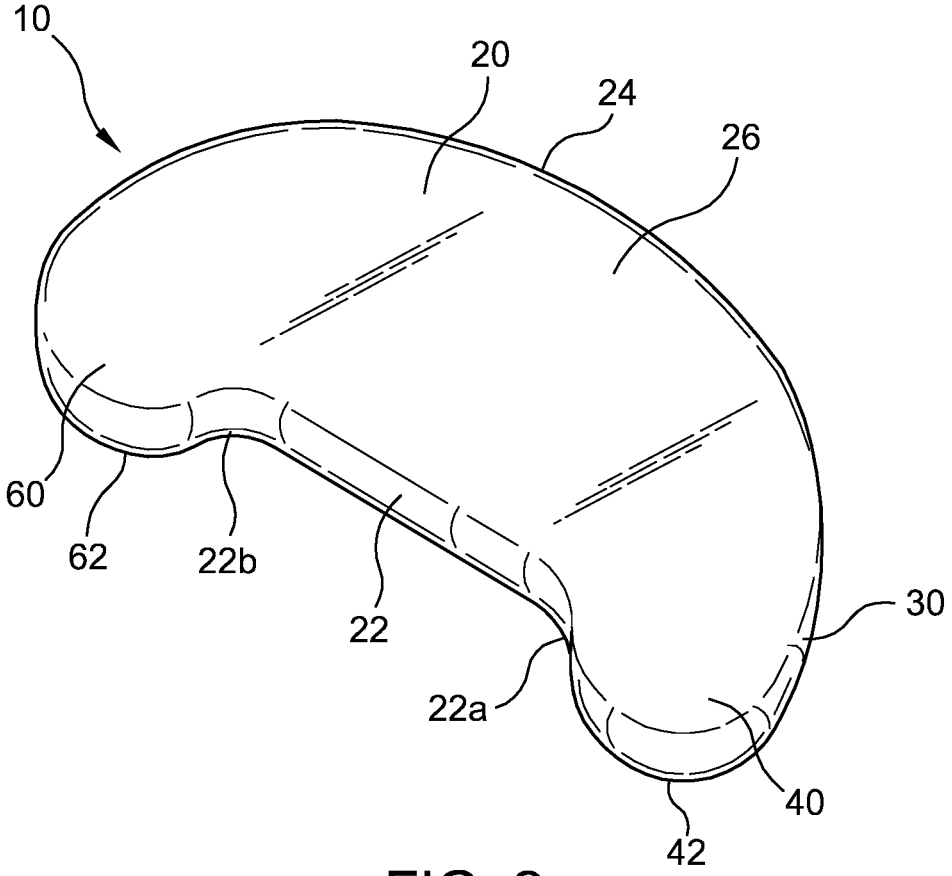
FIG. 1 is a perspective view showing a bodily acupressure and massage article according to the present invention.
Figure 2:
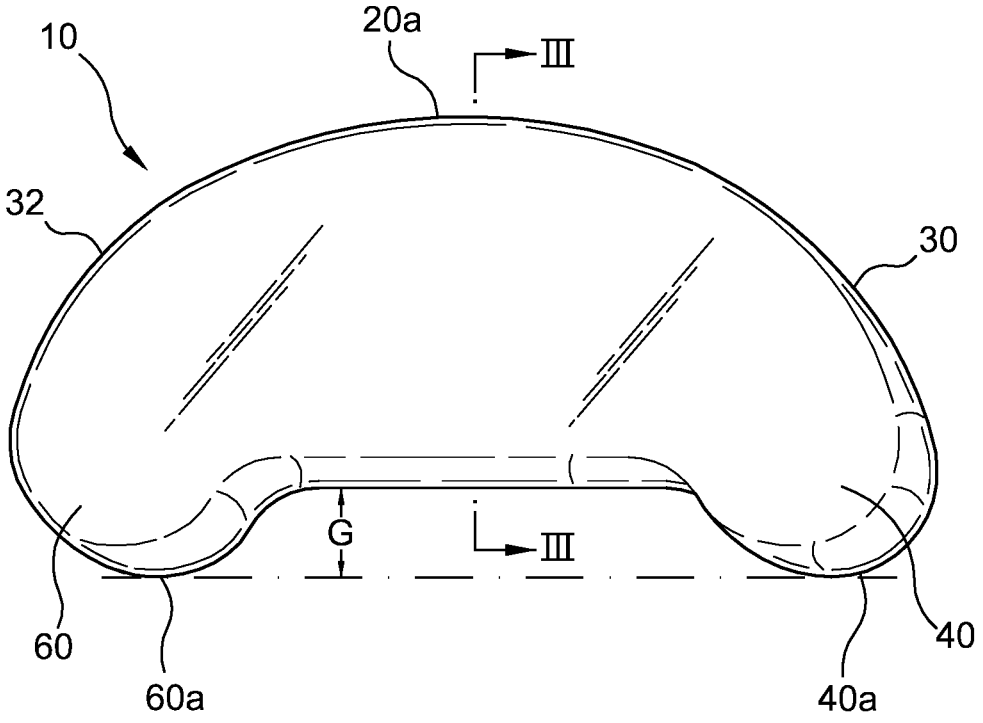
FIG. 2 is a front plan view of FIG. 1.
Figure 3:
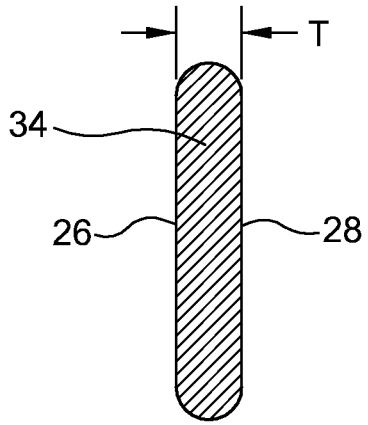
FIG. 3 is a cross section taken along line III-III in FIG. 2.
Figure 4:
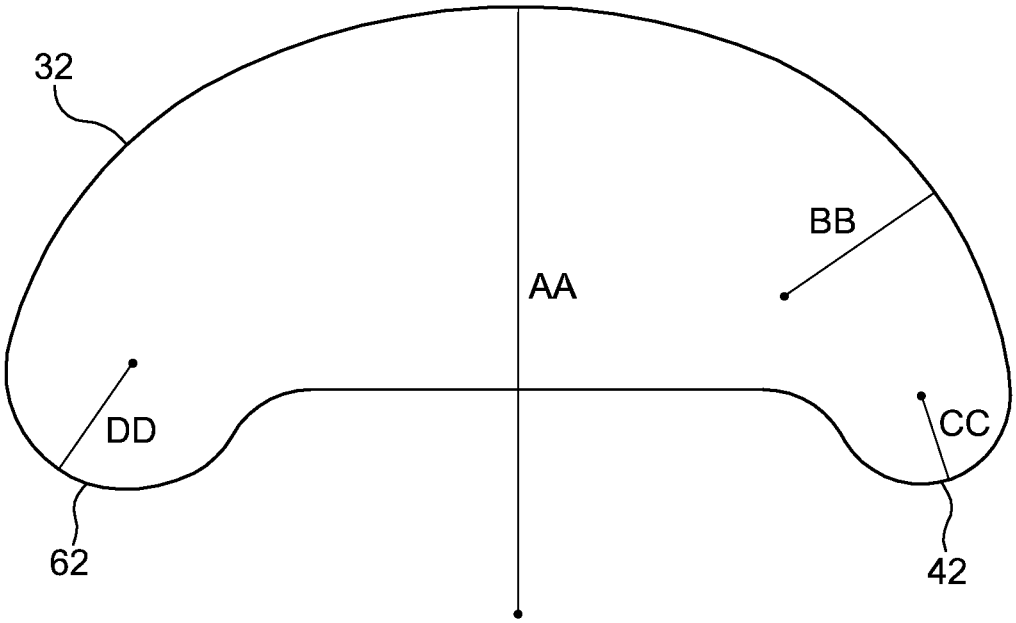
FIG. 4 is a schematic view showing arc radiuses of the acupressure and massage article according to the present invention.
Figure 5:
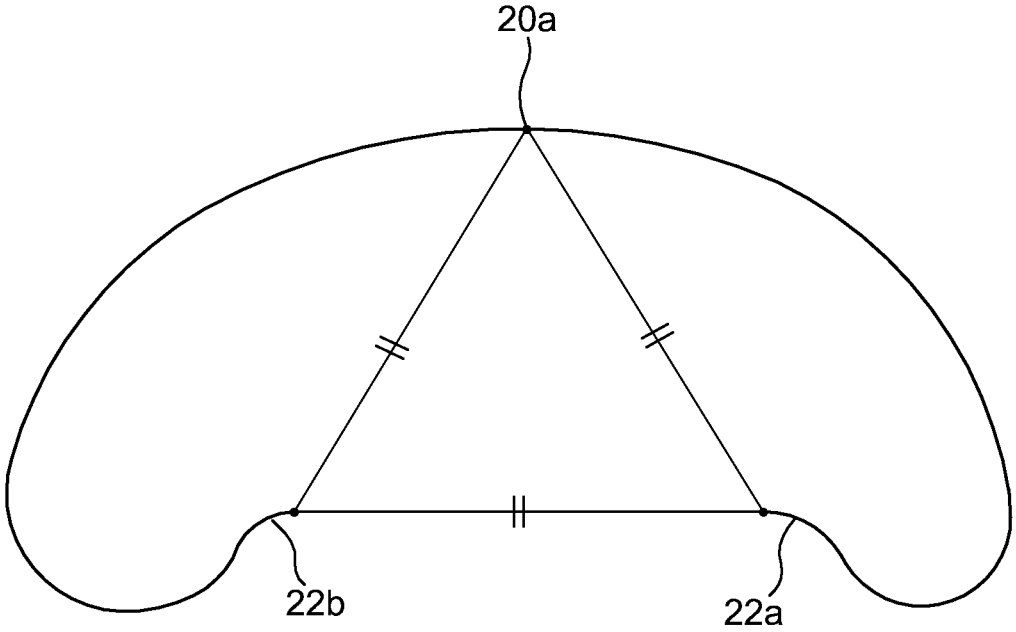
FIG. 5 is a schematic view showing a triangular design scheme applied in the main member of the acupressure and massage article according to the present invention.
Figure 6:
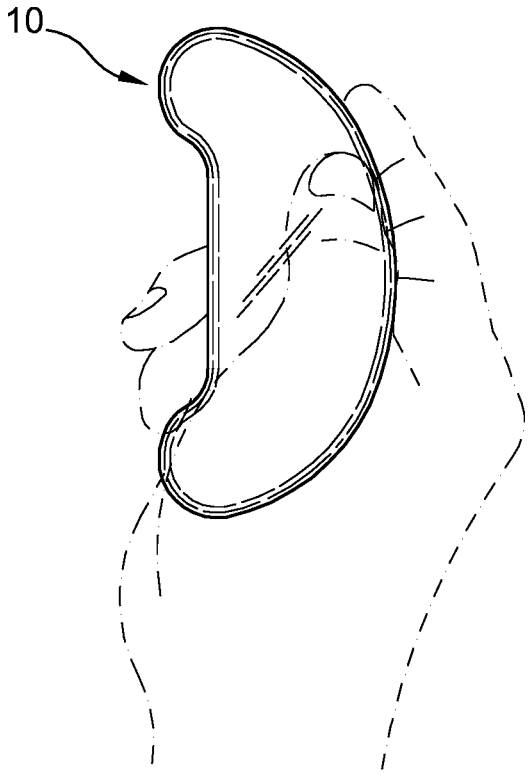
FIGS. 6-8 are schematic viewings showing different grips of the acupressure and massage article according to the present invention.
Figure 7:
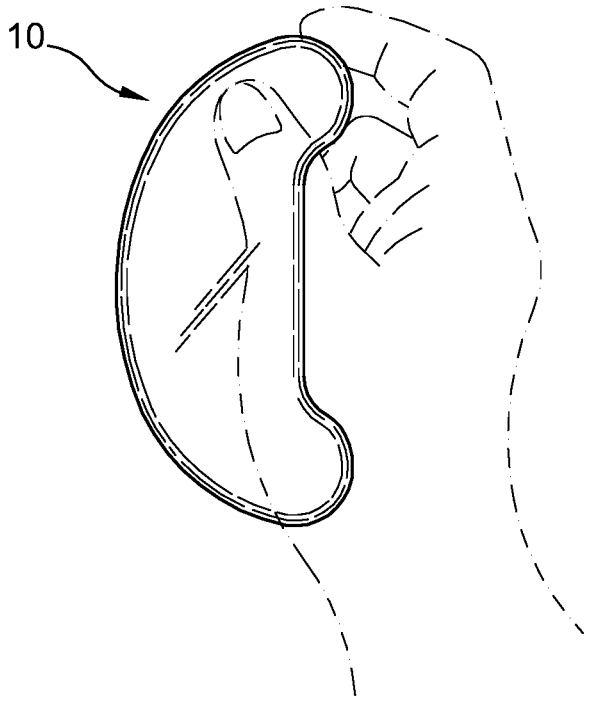
Figure 8:
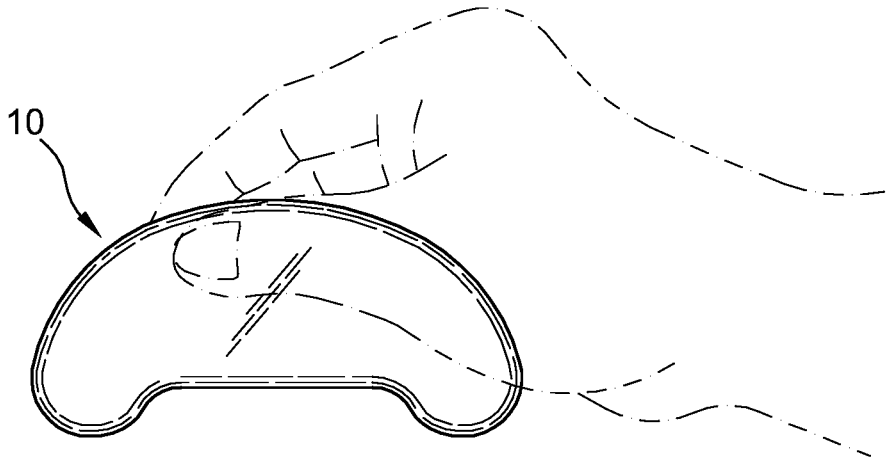

Referring to the accompanying drawings, a bodily acupressure and massage article 10 according to the present invention will now be explained. FIGS. 1-5 show the structure of the acupressure and massage article 10, and FIGS. 6-8 show some of grip variations of the acupressure and massage article 10.

The bodily acupressure and massage article 10 comprises a main member 20 defined by an elongate bottom 22, an arched top 24 formed in accordance with a top arc radius AA, a substantially flat front 26, a substantially flat rear 28, and arched sides 30 each formed in accordance with a side arc radius BB and extending from the arched top 24.

The article 10 further comprises a first protrusion 40 downwardly, outwardly extending from a first end 22*a* of the elongate bottom 22 and semi-circularly formed in accordance with a first protrusion arc radius CC; and a second protrusion 60 downwardly, outwardly extending from a second end 22*b* of the elongate bottom 22 and semi-circularly formed in accordance with a second protrusion arc radius DD.

In this construction, the top arc radius AA is preferably formed larger than the respective side arc radiuses BB, and the side arc radiuses BB are each formed larger than the respective first and second protrusion arc radiuses CC and DD so as to ergonomically streamline the overall structure of the article 10 and facilitate a comfortable grip of the article 10 by a user.

For a better performance, the elongate bottom 22 may be formed larger than a thickness T of the main member 20 in length. The elongate bottom 22 serves to provide stability in a user's grip while separating the first and second protrusions 40 and 60.

In order for the acupressure and massage article 10 to secure a further stability, the elongate bottom 22 may be measured about three times larger than a thickness of the main member 20 in length.

The article 10 may be structure such that a predetermined gap G is formed between the elongate bottom 22 and an imaginary line linking each lower point 42*a* and 60*a* of outer peripheries 42 and 62 of the first and second protrusions 40 and 60, where the predetermined gap may be formed between a half and two thirds of a thickness of the main member 20.

To facility a bodily massage activity by a user, the main member 20 and the first and second protrusions 40 and 60 may be substantially constant and even in thickness.

A looped outer ridge 32 of the article 10 is formed by linking the elongate bottom 22, the arched top 24, the arched sides 30, and respective outer peripheries 42 and 62 of the first and second protrusions 40 and 60. In this construction, a cross section 34 taken against the looped outer ridge 32 may be substantially arched.

The article 10 is preferred to have a construction a uniform thickness so that a thickness of the main member 20 can be formed ranging between 12 mm and 14 mm. The structure according to a design and market preference is to form the thickness of the main member 20 at about 13 mm. Likewise, each thickness of the first and second protrusions 40 and 60 is preferably formed ranging between 12 mm and 14 mm, and each thickness of the first and second protrusions 40 and 60 is preferably formed at about 13 mm. So each thickness of the main member and side protrusions may be substantially identical.

To obtain a better performance, each distance between a tip point 20*a* of the arched top 24 and the first end 22*a* of the elongate bottom 22 is substantially identical, 13. And, each distance between a tip point 20*a* of the arched top 24 and the second end 22*b* of the elongate bottom 22 is substantially identical. So the preferred construction is such that a tip point 20*a* of the arched top 24, and the first and second ends 22*a* and 22*b* of the elongate bottom 22 are equilaterally triangular when linearly connected to one another.

The elongate bottom 22 may be about three times larger than a thickness of the main member 20 in length. The main member 20 and the first and second protrusions 40 and 60 may be formed of an identical material, an identical natural material, a natural wood, a hardened natural wood, a composite wood, or an artificial wood.

Although particular embodiments have been shown and described, it is to be understood that the above description is not intended to limit the scope of these embodiments. While embodiments and variations of the many aspects of the invention have been disclosed and described herein, such disclosure is provided for purposes of explanation and illustration only. Thus, various changes and modifications may be made without departing from the scope of the claims. For example, not all of the components described in the embodiments are necessary, and the invention may include any suitable combinations of the described components, and the general shapes and relative sizes of the components of the invention may be modified. Accordingly, embodiments are intended to exemplify alternatives, modifications, and equivalents that may fall within the scope of the claims. The invention, therefore, should not be limited, except to the following claims, and their equivalents.

What is claimed is:

1. A bodily acupressure and massage article, comprising:

a plate shaped main member defined by an elongate bottom, an arched top formed in accordance with a top arc radius, a substantially flat front, a substantially flat rear, and arched sides each formed in accordance with a side arc radius and extending from the arched top;

a first protrusion downwardly, outwardly extending from a first end of the elongate bottom and semi-circularly formed in accordance with a first protrusion arc radius; and a second protrusion downwardly, outwardly extending from a second end of the elongate bottom and semi-circularly formed in accordance with a second protrusion arc radius, wherein the elongate bottom extends linearly from the first end to the second end, wherein the bodily acupressure and massage article comprises a peripheral end that extends along the arched top, the elongate bottom, the arched sides, and the first and second protrusions, wherein the peripheral end includes first and second portions, wherein in an orientation where the arched top is located higher than the elongate bottom the first portion of the peripheral end extends from the first end to a first lower point of a first outer periphery of the first protrusion, wherein in the orientation where the arched top is located higher than the elongate bottom the second portion of the peripheral end extends from the second end to a second lower point of a second outer periphery of the second protrusion, wherein the elongate bottom is located higher than a first portion highest point of the first portion and a second portion highest point of the second portion of the peripheral end in the orientation where the arched top is located higher than the elongate bottom, wherein the top arc radius is larger than the respective side arc radiuses, and the side arc radiuses are each larger than each of the respective first and second protrusion arc radiuses, wherein the elongate bottom is an only straight edge in the bodily acupressure and massage article, and the bodily acupressure and massage article comprising a material that is rigid, wherein the first protrusion has a first arc radius, wherein the second protrusion has a second arc radius, wherein the first arc radius is larger than the second arc radius, and wherein the arched top forming an only top convex curve surface of the bodily acupressure and massage article, a right side curve surface of the arched sides forming an only right side convex curve surface of the bodily acupressure and massage article and a left side curve surface of the arched sides forming an only left side convex curve surface of the acupressure and massage article, the first protrusion and the second protrusion forming an only two bottom convex curve surfaces of the bodily acupressure and massage article, the first portion and the second portion forming an only two concave curve surfaces of the bodily acupressure and massage article, and wherein a radius of the only right side convex curve surface is equal to a radius of the only left side convex surface, wherein a tip point of the arched top, and the first and second end of the elongate bottom are equilaterally triangular when linearly connected to one another, wherein one of the sides of the triangle is defined by an entire surface of the elongate bottom.

2. The bodily acupressure and massage article of claim 1, wherein a length of the elongate bottom is larger than a thickness of the main member.

3. The bodily acupressure and massage article of claim 1, wherein a length of the elongate bottom is about three times larger than a thickness of the main member.

4. The bodily acupressure and massage article of claim 1, wherein a predetermined gap is formed between the elongate bottom and an imaginary line linking each of the first and second lower points of the first and second outer peripheries of the first and second protrusions, wherein the predetermined gap is between a half and two thirds of a thickness of the main member.

5. The bodily acupressure and massage article of claim 1, wherein the main member and the first and second protrusions are substantially constant and even in thickness.

6. The bodily acupressure and massage article of claim 1, wherein a looped outer ridge of the article is formed by linking the elongate bottom, the arched top, the arched sides, and respective first and second outer peripheries of the first and second protrusions, wherein a cross section taken against the looped outer ridge is substantially arched.

7. The bodily acupressure and massage article of claim 1, wherein a thickness of the main member is formed ranging between 12 mm and 14 mm.

8. The bodily acupressure and massage article of claim 1, wherein each thickness of the first and second protrusions is formed ranging between 12 mm and 14 mm.

9. The bodily acupressure and massage article of claim 1, wherein each thickness of the main member and side protrusions is substantially identical.

10. The bodily acupressure and massage article of claim 1, wherein each distance between a tip point of the arched top and the first end of the elongate bottom is substantially identical.

11. The bodily acupressure and massage article of claim 1, wherein each distance between a tip point of the arched top and the second end of the elongate bottom is substantially identical.

12. The bodily acupressure and massage article of claim 1, wherein a length of the elongate bottom is about three times larger than a thickness of the main member.

13. The bodily acupressure and massage article of claim 1, wherein the main member and the first and second protrusions are formed of an identical material.

14. The bodily acupressure and massage article of claim 1, wherein the main member and the first and second protrusions are formed of an identical natural material.

15. The bodily acupressure and massage article of claim 1, wherein the main member and the first and second protrusions are formed of a natural wood.

16. The bodily acupressure and massage article of claim 1, wherein the main member and the first and second protrusions are formed of a hardened natural wood.

17. The bodily acupressure and massage article of claim 1, wherein the main member and the first and second protrusions are formed of a composite wood.

* * * * *